US006065867A

United States Patent [19]

Sulmont et al.

[11] Patent Number: 6,065,867

[45] Date of Patent: May 23, 2000

[54] METHOD AND DEVICE FOR MEASURING THE TEMPERATURE AND THE LEVEL OF THE MOLTEN ELECTROLYSIS BATH IN CELLS FOR ALUMINUM PRODUCTION

[75] Inventors: Benoit Sulmont, Chambery; Pierre Homsi, Saint-Jean-de-Maurienne; Olivier Granacher, Hermillon, all of France

[73] Assignee: Aluminium Pechiney, Courbevoire, France

[21] Appl. No.: 08/570,496

[22] Filed: Dec. 11, 1995

[30] Foreign Application Priority Data

Dec. 9, 1994 [FR] France ..... 94 15086

[51] Int. Cl.[7] ..... G01K 13/00; G01F 23/24; C25C 3/14

[52] U.S. Cl. ..... 374/139; 374/142; 204/67; 73/292; 73/304 R

[58] Field of Search ..... 73/292, 304 R; 204/243, 245, 372; 205/336, 396; 374/139, 140, 142; 266/94

[56] References Cited

U.S. PATENT DOCUMENTS

| | | | |
|---|---|---|---|
| 3,625,842 | 12/1971 | Bristol | 204/245 |
| 3,629,079 | 12/1971 | Bristol | 204/245 |
| 3,660,256 | 5/1972 | Lippitt et al. | 204/245 |
| 4,124,465 | 11/1978 | Schmidt-Hatting et al. | 204/243 |
| 4,563,255 | 1/1986 | Heinzmann et al. | 204/245 |
| 4,857,157 | 8/1989 | Sulmont et al. . | |

FOREIGN PATENT DOCUMENTS

| | | |
|---|---|---|
| 2 104 781 | 4/1972 | France . |
| 0 288 397 | 10/1988 | France . |

OTHER PUBLICATIONS

Chemical Abstracts, vol. 97, No. 14, Oct. 4, 1982, Abstract No. 117484, G.A. Dudarev, "Monitoring the Processing State of an Aluminium Electrolytic Cell by Immersing a Metallic Probe into an Electrolyte Melt".

Database WPI, Derwent Publications Ltd., London, GB, AN 87–020961, "Aluminium Redn. Cell Electrolyte Temp. Monitoring–By Simultaneously Measuring Cell Voltage and Current in Given Frequency Range to Apply Formula with Regression Coefficients", Jun. 7, 1986.

*Primary Examiner*—Hezron Williams
*Assistant Examiner*—Willie Morris Worth
*Attorney, Agent, or Firm*—Oblon, Spivak, McClelland, Maier & Neustadt, P.C.

[57] ABSTRACT

A method for measuring temperature and electrolyte level of a molten electrolysis bath in a cell for production of aluminum by electrolysis of alumina includes the steps of: (a) piercing the crust of a solidified bath with a crust breaker and immersing into the electrolyte, an extremity of a temperature probe to a sufficient depth until an initial temperature reading of at least 850° C. is measured, then maintaining the immersion of the probe, in said electrolyte for a length of time which is less than the time taken to establish the thermal equilibrium of the probe in the electrolyte, (b) withdrawing the probe and determining a temperature of the electrolyte by extrapolation of the temperature values measured by the probe, (c) measurement of the level of electrolyte in the cell by moving the lower extremity of the probe into contact with the electrolyte while recording potential signals between the cathodic substrate and the probe, and recording position signals corresponding to the position of the probe, and (d) determining the level of the electrolyte by comparison of recorded potential and position signals.

22 Claims, 3 Drawing Sheets

METHOD AND DEVICE FOR MEASURING THE TEMPERATURE AND THE LEVEL OF THE MOLTEN ELECTROLYSIS BATH IN CELLS FOR ALUMINUM PRODUCTION

BACKGROUND OF THE INVENTION

1. Field of the Invention

The invention relates to measurements of temperature and of the level of electrolyte, based on molten cryolite, in cells for production of aluminum by electrolysis of alumina dissolved in said cryolite and to the application thereof for determining the thickness of the molten electrolysis bath in these same cells.

2. Discussion of the Background

The management of modern electrolysis cells for production of aluminum according to the Hall-Héroult process requires continuous surveillance of the temperature and the volume of the molten electrolysis bath. The greater part of the electrolysis bath is in the molten state and constitutes the electrolyte in which the carbonaceous anodes are immersed, the solidified remainder of the bath forms lateral slopes and the crust which covers the free surface of the electrolyte. This electrolyte is essentially constituted by $Na_3AlF_6$ cryolite and can contain various additives such as $CaF_2$, $AlF_3$, LiF, $MgF_2$, and so forth, which have the effect of altering the melting point and electrochemical properties as well as the ability of the bath to dissolve the alumina.

The volume of electrolyte covering the layer of liquid aluminum in contact with the cathode in the base of the cell, or cathodic substrate, has to be sufficient to allow dissolving and rapid separation of the alumina which is introduced in the upper part of the cell. At the same time, it must not exceed a certain level above which it would disturb the thermal equilibrium of the cell and cause corrosion of the steel rounds to which the anodes are attached, and as a consequence pollution with iron of the aluminum produced or metal.

It is therefore advisable to periodically monitor the level of the electrolyte, which represents its volume, that is to say the level of the air/electrolyte interface. This measurement is also useful when combined with measurement of the electrolyte/metal interface, for determining, by difference, the thickness of the electrolyte, that is to say the thickness of the molten electrolysis bath.

In the same way, the knowledge of and constancy in the temperature of the electrolyte are very important, on the one hand for properly regulating the operation of the cell under continuous operating conditions such as to correspond to a thermal equilibrium between the power supplied and the power dissipated, and on the other hand to optimize the electrolysis process, particularly the Faraday yield, taking into account that a simple increase in the temperature of the bath by ten degrees celsius can lower the Faraday yield by 1 to 2%, while conversely, a lowering of the temperature of the electrolyte by ten degrees celsius can, in the temperature zone under consideration (about 950° C), reduce the already weak solubility of the alumina in the cryolite and promote "the anode effect", that is to say polarization of the anode, with a sudden increase in tension at the limits of the cell and the release of a large quantity of fluorided products produced by the breakdown of the electrolyte.

These measurements of the temperature and of the level of the bath are currently carried out manually by an operator, who periodically opens the door or cell lids and dips an insertion pyrometer into the electrolyte to measure the temperature, then a steel rod to measure the level and the thickness of the electrolyte. It is not possible to use a probe continuously immersed in the electrolyte because of its highly aggressive nature. This method clearly has a number of disadvantages, in particular from the point of view of:

- releases of fluorided gases into the surrounding atmosphere during opening of the door or the cell lids,
- working conditions which expose the operator to these releases of gas,
- the low frequency (1 measurement per 24 to 48 hours) of these measurements which are difficult to undertake, which does not allow sufficiently regular and accurate monitoring of the temperature and the level of the electrolyte with respect to the new demands of management of high intensity cells.

Even the recent prior art only provides very incomplete solutions to these problems, while totally neglecting the aspect of measurement of temperature and advocating methods for measuring the level or the thickness of the electrolyte, the precision of which is still debatable, and moreover involving the use of individual control of the height of the anode over the cells. Thus EP 0195143 describes a method for measuring the level of the electrolyte in an electrolysis cell, according to which one of the anodes passed through by a given current is progressively raised, the reduction in current is measured according to the increase in the distance between the poles, that is to say the height raised, and the height at which the current has reduced to a pre-determined fraction of its initial value is noted. After calibration, the level of the electrolyte can be deduced. For this, the initial distance between the poles and a geometric correction term are added to the distance travelled by the anode.

In fact, this method supposes a very high degree of homogeneity of the electrolyte, whereas its resistivity varies locally and over time with its composition, and particularly with the content of alumina dissolved. Furthermore, this method necessitates significant movement of the anode which can disturb the working of the cell when this operation is repeated too often.

In the same way, EP 0288397 describes a method for monitoring the additions of solidified bath to an electrolysis cell, consisting of periodically determining the thickness of the electrolyte HB, which is compared to a reference variable HC and then adjusted accordingly. To obtain HB it is necessary, in an intermediate step, to measure the level of the bath with respect to a fixed point of reference, and this measurement is carried out by means of a probe connected to a level sensor and equipped with a tip electrically connected to the cathode of the electrolysis cell. When the tip comes into contact with the air/electrolyte interface, a large increase is recorded in the tip/cathode potential. Regardless of the fact that this method does not provide any operating data for this intermediate measurement of level (frequency, precision and accuracy) taking into account particularly the disturbing effect of the deposition of solidified bath on the probe, it in no way deals with the essential problem of the measurement of the temperature of the electrolyte.

To summarize, no method or device according to the prior art completely and satisfactorily resolves the problem of precise and accurate measurement of the temperature and of the level of the electrolyte in cells for the production of aluminum by electrolysis in order to eliminate the usual manual measurements.

SUMMARY OF THE INVENTION

The method according to the invention, and the device to implement it, make possible not only the alleviation of the disadvantages of manual measurements of temperature and of the level of the electrolyte, but also provide novel advantages resulting from their automation, in particular:

greater precision in the measurements of temperature to ±2° C. (instead of ±5° C. by the manual method) and of the level of the electrolyte to ±5mm (instead of ±10 mm by the manual method) together with increased accuracy in the management of electrolysis cells because of the greater frequency of measurements, preferably every 30 minutes to 48 hours instead of every 24 to 48 hours, allowing elimination of abnormal measurements occurring, particularly during the transient operating conditions of the cell.

a gain in productivity, consecutive with the elimination of the task of manual measurement, together with a very substantial improvement in working conditions in the proximity of the cells with the ending of the opening of the door or the lids.

More precisely, the invention relates to a method for measuring the temperature and the level of the molten electrolysis bath, or electrolyte, in a cell for production of aluminum by electrolysis, preferably in a cell for production of aluminum by electrolysis according to the Hall-Héroult process, of alumina dissolved in said electrolyte in contact with the carbonaceous anodes, and resting on the sheet of liquid metal formed on the cathodic substrate, the surface of which in contact with the air in the upper part of the cell is covered by a crust of solidified bath, characterized in that with the aid of an appropriate device, integral but electrically insulated from the superstructure of the cell, provided in particular with means for breaking the crust of the solidified bath, or a crust-breaker, and means for measuring the temperature and the level of electrolyte, the following sequence of operations is carried out periodically, and preferably according to a periodicity of 30 minutes to 48 hours:

a) piercing of the crust of solidified bath and immersion into the electrolyte, through the aperture thereby created, of the extremity of a temperature probe to a sufficient depth until a temperature of at least 850° C., and preferably 920° C. is obtained, then maintaining the immersion of the probe for a pre-determined length of time, which is less than the time taken to establish the thermal equilibrium of the probe with the electrolyte, b) after optional withdrawal of the probe, determination of the temperature of the electrolyte by extrapolation of the temperature values established by the probe above 850° C. and preferably 920° C., according to a pre-established calibration data preferably in the form of a computation program, c) after optional clearing of the aperture for the passage of the probe previously created, and optional removal of the solidified bath deposit from said probe, measurement of the level of electrolyte in the cell from a reference or datum point by recording the variation in potential between the cathodic substrate and the probe, the position of which is determined by a potentiometer, and the potential of which increases, preferably rapidly and significantly, when the lower extremity of the probe or tip comes into contact with the electrolyte, d) optional raising of the probe and e) optional calculation of the level of the electrolyte by the sensor after establishment of potential/position signals from the tip.

The invention also relates to the appropriate device for carrying out the method, that is to say the device for crust-breaking and measuring what is intended to be measured, after piercing of the superficial crust of solidified bath, the temperature and the level of the electrolyte in a cell for the production of aluminum by electrolysis of alumina dissolved in the electrolyte, said device, which is integral but electrically insulated from the superstructure, comprising crust-breaking means or a crust-breaker, being characterized in that it is provided with means for measuring the temperature and the level of the electrolyte, preferably principally constituted by a cylindrical probe moving vertically along its main axis inside the crust-breaking means, automatically carrying out, according to a pre-determined operating sequence, the periodic monitoring of this temperature and of this level, and that said crust-breaking means also make possible the optional removal of the deposit of solidified bath on the measuring probe.

The invention according to the method and the implementing device can be applied not only to the measurement of the level of the electrolyte but also to measuring the level of the metal at the electrolyte/liquid metal interface, and consequently to the automatic determination of the thickness HB=HT−HM, where HT represents the distance of the level of the electrolyte (air/electrolyte interface) from a fixed reference level, and HM is the distance of the level of the metal (electrolyte/liquid metal interface) from this same fixed level. In this application the invention constitutes another improvement in the method according to EP 0288397, incorporated herein by reference and already analyzed in the prior art of the patent application.

Because of the short lifetime of thermocouple probes continuously immersed in the electrolyte due to its highly aggressive nature, and also because of the necessity for increasing the frequency of temperature monitoring carried out manually at the same time as the measurement of the electrolyte, the inventors have developed an automatic method for measuring the temperature and the level of the electrolyte and an appropriate device for its implementation, having found that very frequent measurement of temperature with a high degree of precision is possible by intermittent immersion of a temperature probe in the electrolyte for a relatively short time does not necessitate the establishment of thermal equilibrium of the probe with the electrolyte from the instant when one can correctly extrapolate its cessation in temperature increase.

In order to do this the inventors have found particularly that:

1°) the increase in temperature of the temperature probe between 850° C. and 1050° C., the normal operating range, obeys a law of development over time, the asymptotic curve of which can be calculated by extrapolation of the curve obtained over a short period of time.

2°) only the last N acquisitions by the probe indicating a temperature higher than or equal to 850° C., and preferably higher than or equal to 920° C. have to be taken into account to determine the equilibrium temperature or measurement of temperature of the electrolyte by extrapolation.

3°) the number N of these temperature acquisitions ($N \geqq 10$), carried out generally every 0.1 to 60 seconds, is limited and thus defined by the condition of withdrawal from the electrolyte of the probe at above 850° C. and preferably at 920° C., which is a speed of increase in temperature below a pre-determined threshold, preferably between 0.1 and 10° C. per second.

This limit is generally reached minus a few seconds to a few minutes before the probe reaches its thermal equilibrium, that is to say the temperature of the electrolyte. Thus for measuring the temperature, the total duration of immersion of the probe in the electrolyte, the temperature of which is on the order of 950° C., is preferably between 30 seconds and 30 minutes, without its temperature generally exceeding 940° C.

These measurements of the temperature of the electrolyte by extrapolation of the equilibrium temperature of the probe have been confirmed by simultaneous measurements of temperature carried out with thermocouple probes of the same type continuously immersed in the electrolyte until their destruction, and in the proximity of the aperture for passage of the probe intermittently immersed. Thus it was possible to overcome the degrees of local heterogeneity in composition and temperature of the electrolyte and to prove that the differences in temperature measured according to the two monitoring methods were within a range of ±2° C., which is the order of magnitude of precision which can be reached with correctly calibrated thermocouples.

It should be noted in the present case that the method according to the invention is not linked to a particular method of producing aluminum or extrapolation of the equilibrium temperature. It also includes any aluminum production process using hot electrolyte and any method intended to pre-determine the equilibrium temperature of the probe from a time for which the probe is kept immersed, which is less than the real time of establishment of the equilibrium of temperature of the probe and that of the electrolyte.

Preferably, other features concerning, in particular, the conditions for using the probe should be taken into account to obtain a precise and reproducible measurement of temperature.

this firstly relates to the depth of immersion of the probe, which should be defined precisely. Indeed a significant error can take place due to thermal losses by conduction and by radiation along the probe, as the temperature of the measuring point (at the end of the probe) is always less than that of the electrolyte under continuous operating conditions. The depth of immersion should be at least 1 centimeter.

it also concerns the regular cleaning of the external surface of the probe, ensured by the crust-breaker which surrounds said probe and the vertical translation movement of which causes the detachment of the deposit of solidified bath. It is preferred that the lower extremity of the periodically immersed probe is regularly relieved of its deposit of solidified bath on its external surface. Because it increases both the thickness and the length of the probe, it can on the one hand alter the conditions of electrolyte/probe thermal exchange, and therefore the measurement of the temperature, and on the other hand the threshold for detection by the tip when it enters the electrolyte, and as a result the measurement of the level of electrolyte.

Finally the relatively high frequency of temperature measurements, preferably every 30 minutes to 48 hours, with the possibility of selecting and of discounting abnormal measurements, even those which are simply doubtful, when they are carried out during periodic selective operations which temporarily alter the state of equilibrium of the cell, contributes to increase the accuracy of the process of management of the cells.

This selection is carried out by the control and regulation system of the cell preferably connected to a computer which, after clearing the aperture for passage of the probe and the removal by scraping of the deposit of solidified bath, makes it possible to carry out measurement of the level of electrolyte by immersion of the tip, connected on the one hand to a movement sensor and on the other hand to the cathodic substrate, the difference in potential of which, with respect to said substrate, increases extremely rapidly when the tip enters into contact with the electrolyte. Increases of 1, 2, 5, 10%, etc. can be measured as well as 15%, 20%, etc.

The sensor proceeds with the establishment of 2 position/potential signals for each measurement, which it transforms into the level of electrolyte with respect to a reference point expressed in mm. These values for the level are then transmitted to the system for control and regulation of the cell for determination of the average level of the electrolyte after removal of doubtful or aberrant measurements.

BRIEF DESCRIPTION OF THE DRAWINGS

The invention will be better understood by the following detailed description of its implementation by means of the appropriate device for crust-breaking and measuring, with reference to FIGS. 1A to 3, respectively concerning:

a schematic drawing of the whole of a device for crust-breaking and measuring, with its principal connections (FIG. 1A).

Figure 1A:
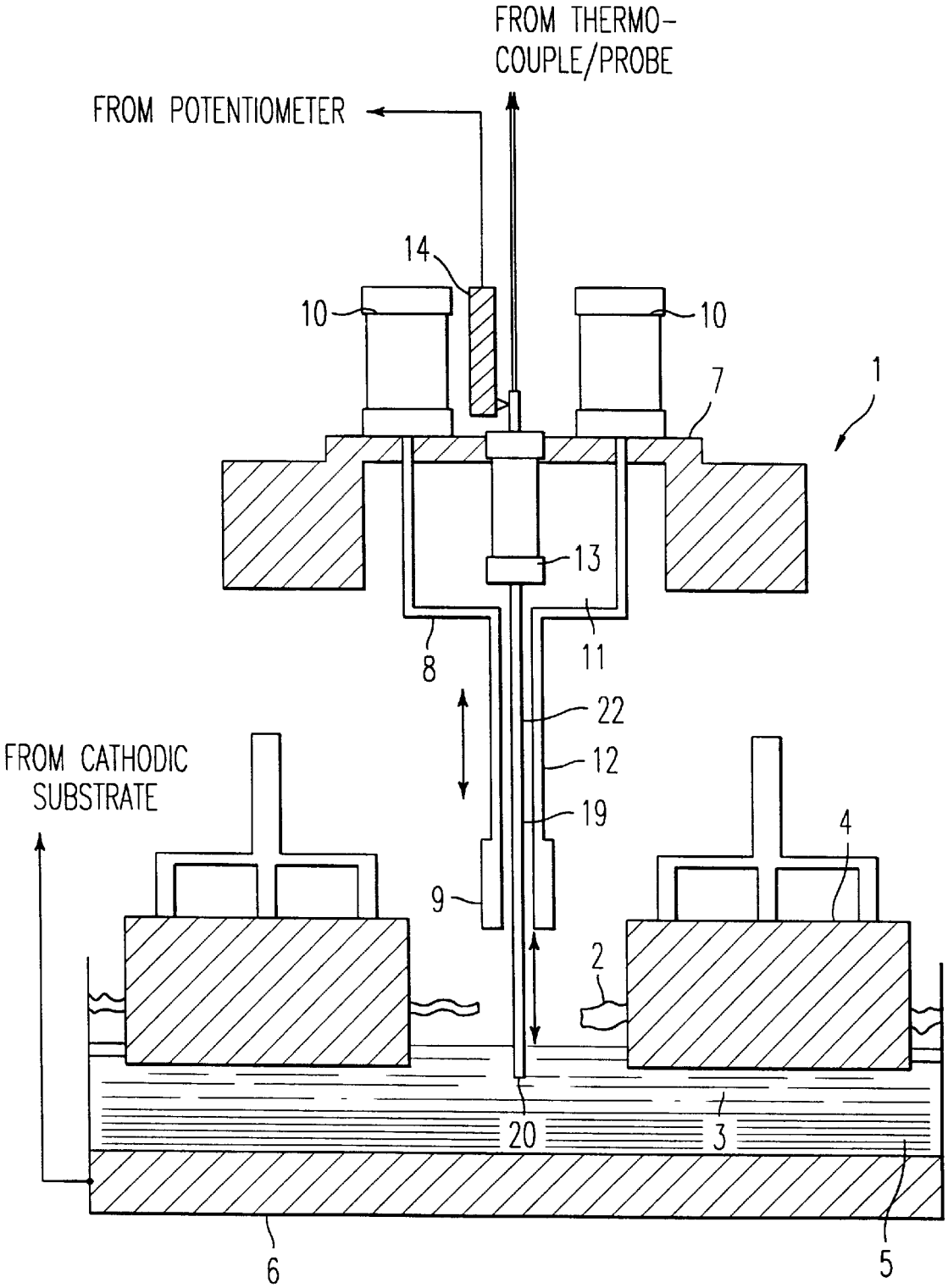
Figure 2A:
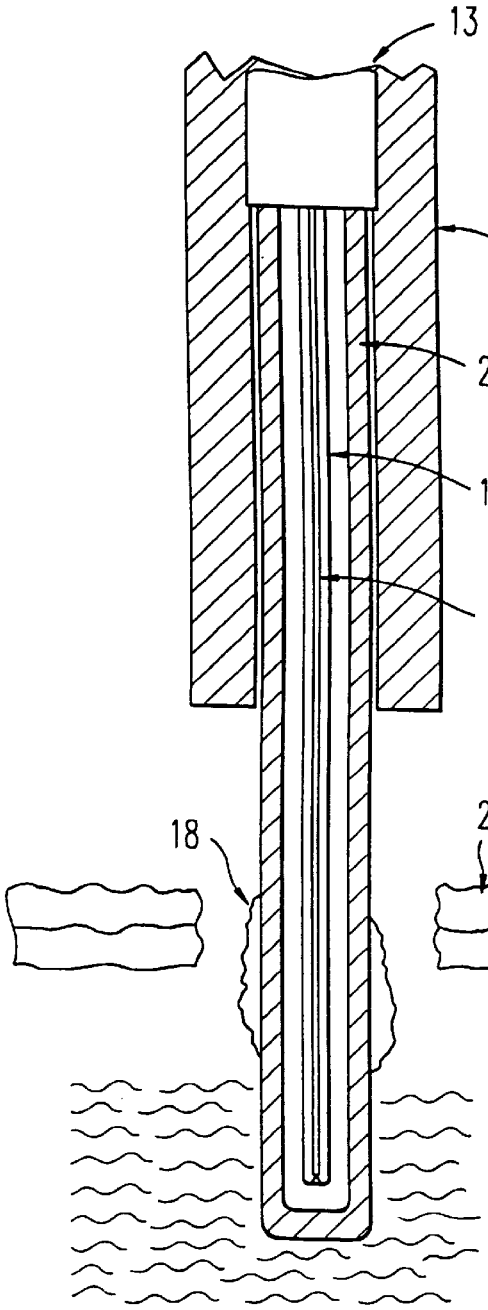
Figure 2B:
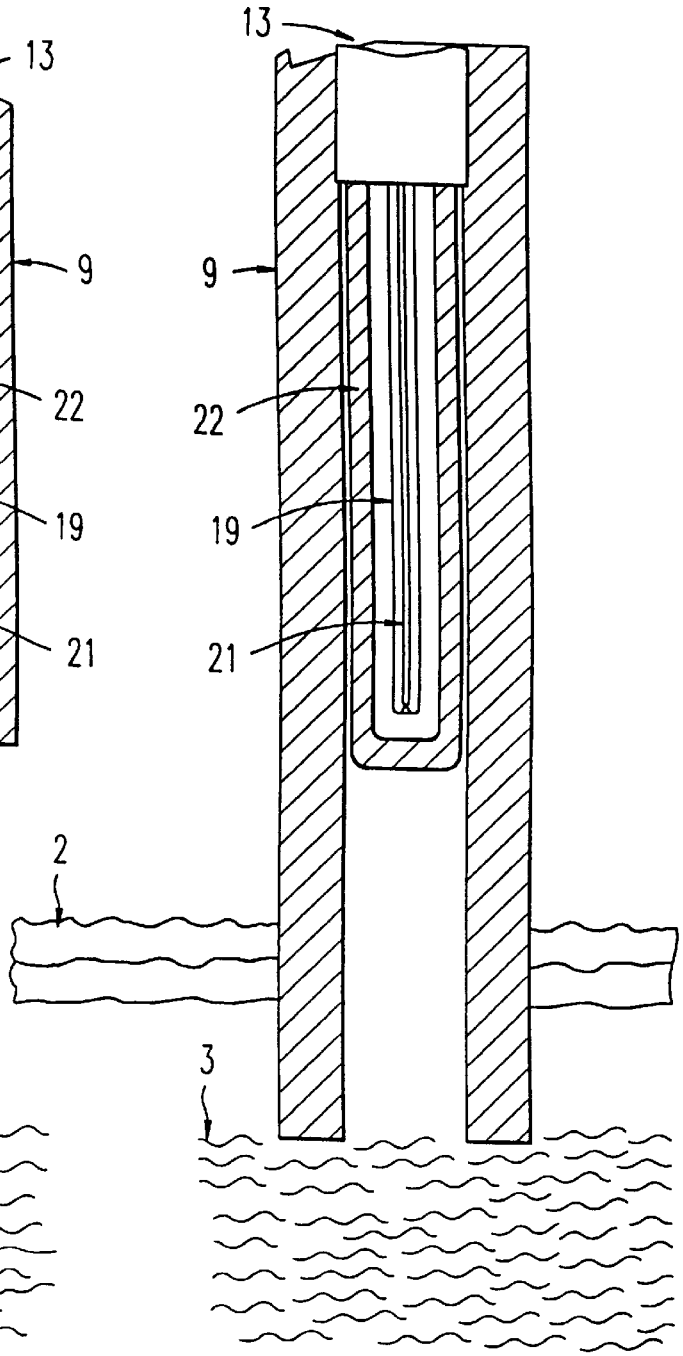

A schematic drawing of a longitudinal section of the lower part of a device for crust-breaking and measuring, the crust-breaker being in the raised position, and the probe in the immersed position in FIG. 2*a,* and the crust-breaker being in the lowered position and the probe raised in FIG. 2*b.* different configurations for mounting the actuators for crust-breaking and measuring (FIGS. 3*a,* 3*b,* 3*c,* 3*d*) which in no way limit the scope of the invention to these sole methods of implementation.

DETAILED DESCRIPTION

The device for crust-breaking and measuring 1 is intended, after piercing of the crust 2 of the solidified bath, for measuring the temperature and the level of the electrolyte 3 in contact with the carbonaceous anodes 4 and above the layer of liquid or metal aluminum 5 lying on the cathodic substrate 6. It is integral with, but electrically insulated from, the superstructure 7 of the cell and comprises crustbreaking means 8 preferably formed on the lower part by a hollow cylindrical crust-breaker 9 operated by at least one actuator 10, driven by a vertical translation movement to pierce and then maintain an aperture for passage in the crust, allowing means 11 for measuring the temperature and the level of the electrolyte to be used, which are preferably constituted by a cylindrical probe 12. By its vertical translation movement, the crust-breaker 9 allows simultaneous removal, by scraping, of the deposit 18 of solidified bath on the external surface of said probe. In this respect the clearance between the crust-breaker 9 and the probe 12 according to FIGS. 2*a* and 2*b* has to be sufficient (0.5 to 20 mm radius) to allow their relative displacement without friction, but must not be too large in order to avoid progressive formation of too large a deposit of solidified bath on the lower part of the probe 12.

The vertical movement of this probe, which is preferably moveable inside the crust-breaker 9, which takes place coaxially with respect to the axis of the crust-breaker, is ensured by a measuring actuator 13. A potentiometer 14 makes possible precise determination of the height position of the probe and at the same time a voltmeter 15 (not pictured in figures) measures the difference in potential between the probe 12 and the cathodic substrate 6. In particular when the lower extremity of the probe or tip 20 comes into contact with the electrolyte 3, a level measuring circuit 16 (not pictured in figures) proceeds with the establishment of the 2 signals with each lowering and raising of the probe, and calculates the level of the electrolyte/air interface, which is transmitted to the control and regulation system 17 (not pictured in figures).

The probe 12 is preferably constituted by an external cylindrical case 22, for example made from stainless steel, 100 to 600 mm in length, 7 to 100 mm in external diameter, and with a wall thickness which does not exceed 40 mm and is preferably between 2 and 10 mm to reduce thermal losses. A thermocouple 21 in its casing 19 is placed in the central hollow space. This thermocouple is electrically connected by its upper part to the control and regulation system 17, (not pictured in figures) which determines the temperature of the electrolyte by extrapolation of the probe.

Figure 3A:
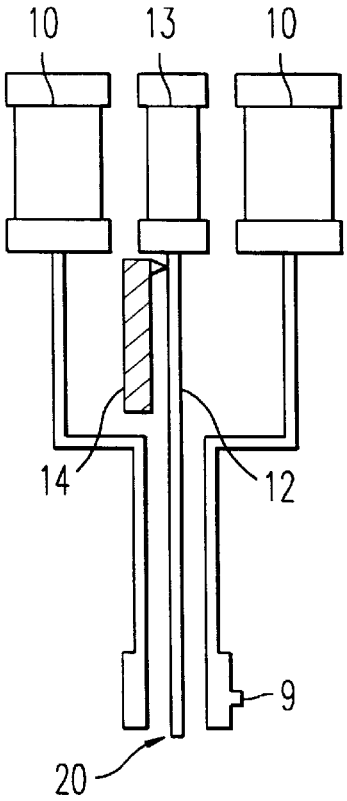

Several preferable variations of the crust-breaking device were particularly studied and are shown by FIGS. 3*a,* 3*b,* 3*c* and 3*d,* which cannot in any way be considered as a limitation of the invention to these configurations alone. For example, any device capable of breaking the crust herein can be used, including a metal rod, a jet of air, etc. Preferably, the crust breaker can be used several times, but this is not required. The temperature probe is similarly not limited to the above embodiments and need not be contained within the crust breaker. Thermocouples, thermometers, temperature sensitive materials, etc. can all be used as the probe herein. Preferably the probe is reusable.

In the configuration according to FIG. 3*a,* the measuring actuator with the cross rod for displacing the probe 12 has been replaced with a simple actuator which makes possible a reduction in the height of the device for crust-breaking and measuring, and an increase in the power of movement of the measurement.

Figure 3B:
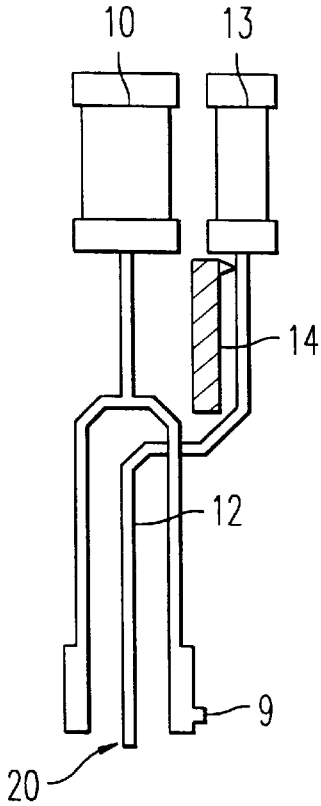

In the configuration according to FIG. 3*b,* only a central actuator 10 is used for the crust-breaking and an off-center 13 actuator for the measurement (or conversely a central actuator for the measurement and an off-center actuator for the crustbreaking). The objective is the reduction of the number, and therefore the cost, of the actuators and above all of the height and width occupied.

Figure 3C:
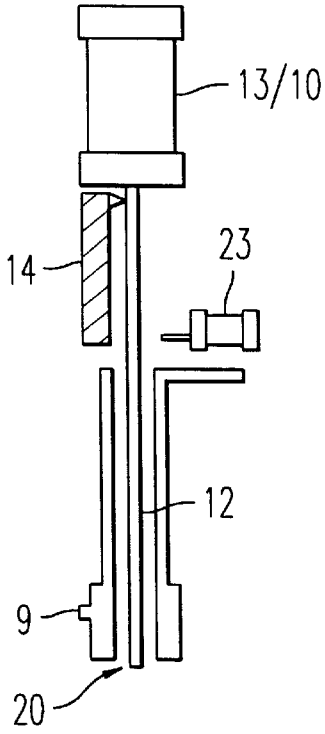

Lastly, the configuration according to FIG. 3*c* wherein the use of a single actuator 13/10 to displace the crust-breaker and the probe with a mechanism 23, allows locking of the crust-breaker, makes possible a reduction in the cost of the actuators and a reduction in the height and width occupied, and increases the power of movement of the probe.

Figure 3D:
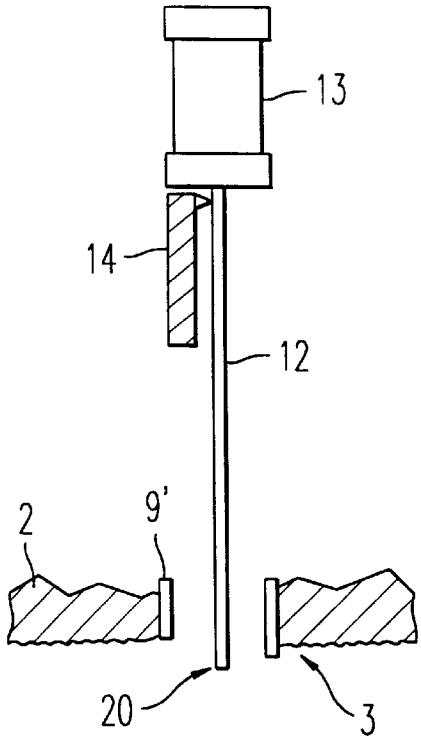

With respect to the simplified configuration according to FIG. 3*d,* consisting of replacing the crust-breaking function, intended to produce an opening in the crust of solidified bath, by a fixed protector 9' allowing a hole to be maintained in the crust, this simplifies the device for crust-breaking and measuring with a single actuator 13.

Having specified these structural features, the device for crust-breaking and measuring 1 of the temperature and the level of the electrolyte 3 is preferably used at regular intervals, generally every 30 minutes to 48 hours, in the following way in order to manage cells for production of aluminum:

using the actuators 10, the crust-breaker 9 is lowered to the level of the solidified bath for piercing or clearing the hole already formed in the crust 2, then after 1 to 5 seconds is raised the probe 12, in its raised position, the lower extremity 20 of which is at least 50 cm from the level of the electrolyte, is then lowered by the actuator 13 to the immersion depth intended, preferably 8 to 16 cm from the lower extremity or tip 20.

The duration of immersion of the probe in the electrolyte, the temperature of which, depending on its composition, is approximately 950° C., corresponds to the time curve in view of eliminating interference effects which can disturb the signals from the potentiometer and of the tip. The value thus calculated is then transmitted to the control and regulation system 17 (not pictured in figures).

Apart from the fact that it is possible to carry out, without manual intervention and without risk of pollution, more than 2,000 measurements of temperature to ±2° C. with a probe, with increased accuracy of the management of the cells because of the increased frequency of the measurements of temperature and of level, as well as the selection of the time to carry them out outside periods of transitory operation of electrolysis cells, the method and the device according to the invention are also capable of being adapted for the measurement of the level of the electrolyte/metal interface. Indeed, in a similar manner, by sinking the probe into the layer of metal a new variation in potential between the cathode substrate and the tip of the probe can be recorded when the probe crosses the electrolyte/metal interface. This variation is translated by a large reduction in probe-metal/cathode potential difference with respect to the probe-electrode/cathode potential difference previously recorded as a result of the substantial reduction in the resistance of the new medium.

In this way, from a common origin, by two successive series of measurements of the level of electrolyte and measurements of the level of metal, the average level of the electrolyte HT and the average level of the metal HM can be of acquisition by the probe of a temperature of at least 850° C. and preferably 920° C., increased by the time necessary to obtain, from this temperature, a very slow speed of heating of the probe, for example of less than 3° C. per second.

When this threshold is reached, the probe is raised to its initial position and the successive values of temperature measured by the thermocouple 21 are transmitted to the control and regulation system 17 (not pictured in figures) which determines, by extrapolation of the N different pairs of time/temperature values (ti, Ti), the temperature Tb of the electrolyte.

To carry out measurement of the level of the electrolyte, as a precaution the crust-breaker 9 is lowered in order to ensure the cleaning and passage of the probe 12 and then its raising, which allows the initiation of the sequence of measurement of the level of the electrolyte. This comprises the detection of the potential of the probe 12 with respect to the cathodic substrate 6 and the position signal from the potentiometer 14.

When the probe 12 is lowered, the potential with respect to the cathode 6 increases extremely rapidly when the tip 20 comes into contact with the bath 3, then drops back when this same tip leaves the electrolyte when the probe is raised after a duration of immersion preferably not exceeding 20 seconds. These variations in potential are recorded by the level measuring circuit, which precisely determines the instant when the probe dips into the electrolyte and calculates the thickness of the electrolyte after filtering and smoothing of the recording rapidly determined, and from these HB=HT−HM can be deduced, this being the thickness of the electrolyte, the volume of which one wishes to regulate precisely by the addition of ground solid bath or removal of electrolyte. This manner of determining the thickness of the electrolyte is clearly faster than that advocated by EP 0288 397, incorporated herein by reference, based on the indirect determination of the metal level from the poorly defined anodic plane and from the speed of wear of the anodes. In this respect the application of the method and the device according to the invention to the measurement of the thickness of the electrolyte with a view of its regulation constitutes both a complement to and a development of the method according to EP 0288397.

The application is based on French patent application 94 15086 filed Dec. 9, 1994, incorporated herein by reference.

What is claimed as new and is desired to be secured by Letters Patent of the United States is:

1. A method for measuring temperature and electrolyte level of a molten electrolysis bath in a cell for production of aluminum by electrolysis of alumina dissolved in said electrolyte, said electrolyte being in contact with carbonaceous anodes and resting on a sheet of liquid metal formed on a cathodic substrate, the surface of said electrolyte being in contact with air in an upper part of the cell and covered by a crust of solidified bath, comprising the steps of:

a) piercing of the crust of solidified bath with a crust breaker and immersing into the electrolyte, through an aperture thereby created, an extremity of a temperature probe to a sufficient depth until an initial temperature reading of at least 850° C. is measured, then maintaining the immersion of the probe, measuring additional temperature values over time, in said electrolyte for a length of time, which is less than the time taken to establish the thermal equilibrium of the probe in the electrolyte, b) withdrawing the probe and determining a temperature of the electrolyte by extrapolation of the additional temperature values measured by the probe by comparison with pre-established calibration data, c) measurement of the level of electrolyte in the cell by moving the lower extremity of the probe into contact with the electrolyte while recording potential signals between the cathodic substrate and the probe, and recording position signals corresponding to the position of the probe, d) determining the level of the electrolyte by comparison of recorded potential and position signals.

2. The method according to claim 1, wherein the steps for measuring the temperature and the level of the electrolyte is carried out repeatedly according to a periodicity of from 30 minutes to 48 hours.

3. The method according to claim 1, wherein the length of time the probe is kept in the electrolyte at above 850° C. is defined by a condition of withdrawal of the probe, which is a speed of temperature increase less than a value between 0.1 and 10° C. per second.

4. The method according to claim 1, wherein for a measurement of the temperature, a total immersion time of the probe in the electrolyte is between 30 seconds and 30 minutes.

5. The method according to claim 1, wherein the depth of immersion of an extremity of the probe in the electrolyte is at least 1 cm.

6. The method according to claim 1, wherein the removal of the deposit of solidified bath on a external surface of the probe is regularly carried out with the aid of the crust-breaker driven by a vertical translation movement.

7. The method according to claim 6, wherein during the measurement of the level the extremity of the probe or tip is immersed in the electrolyte for a duration not exceeding 20 seconds.

8. A device for crust-breaking and measuring the temperature and the level of electrolyte in a cell for production of aluminum by the electrolysis of alumina dissolved in the electrolyte, comprising a crust-breaker, a temperature probe, means for moving said temperature probe vertically along its main axis inside said crust breaker, means for measuring the height position of the temperature probe, and means for measuring the difference in potential between the temperature probe and a cathodic substrate, and which together carry out the periodic monitoring of the temperature and level of the electrolyte.

9. The device for crust-breaking and measuring according to claim 8, wherein the crust-breaker is formed by a hollow cylinder, operated by at least one actuator.

10. The device according to claim 9, wherein the temperature probe is a cylindrical probe moveable inside the crust-breaker, the vertical displacement of which coaxially to the principle axis of the crust-breaker is made by said at least one actuator, or another actuator.

11. A device for crust-breaking and measuring according to claim 8, wherein a potentiometer is fixed to an actuator and said potentiometer generates position signals.

12. A device for crust-breaking and measuring according to claim 8, wherein the means for measuring the difference in potential between the temperature probe and the cathodic substrate includes a voltmeter.

13. A device for crust-breaking and measuring according to claim 12, further comprising measuring circuit means connected electrically to the voltmeter and to a potentiometer for calculating the level of electrolyte in the cell.

14. A device for crust-breaking and measuring according to claim 8, wherein the crust breaker is an external cylindrical casing, 100 to 600 mm long and 7 to 100 mm in external diameter, with a wall thickness not exceeding 40 mm.

15. The device for crust-breaking and measuring according to claim 14, wherein the external cylindrical casing of the probe has a wall thickness of between 2 and 10 mm.

16. The device for crust-breaking and measuring according to claim 14, wherein the external cylindrical casing contains a thermocouple in a thermocouple casing, connected electrically by its upper part to a control and regulation system (17).

17. The device for crust-breaking and measuring according to claim 10, wherein the clearance between the crust-breaker and the probe is between 0.5 and 20 mm.

18. The device for crust-breaking and measuring according to claim 10, wherein the at least one or another actuator which moves the probe is in the center of said device.

19. The device for crust-breaking and measuring according to claim 10, wherein the actuator which moves the probe is off-center and the crust-breaking actuator is in the center of said device.

20. The device for crust-breaking and measuring according to claim 10, wherein a single actuator operates said crust-breaker and said temperature probe.

21. The device for crust-breaking and measuring according to claim 1, wherein a potentiometer generates said position signals.

22. The method of claim 1, further comprising:

clearing of the aperture for the passage of the probe previously created, and removal of any solidified bath deposit from said probe, prior to the measurement of the level of electrolyte; and raising of the probe, prior to the determining of the level of the electrolyte.

* * * * *

UNITED STATES PATENT AND TRADEMARK OFFICE

CERTIFICATE OF CORRECTION

PATENT NO. : 6,065,867
DATED : May 23, 2000
INVENTOR(S) : Benoit Sulmont et al.

It is certified that error appears in the above-identified patent and that said Letters Patent is hereby corrected as shown below:

Column 8,
Lines 1-65, insert the following on the attached page.

Signed and Sealed this

Thirteenth Day of August, 2002

*Attest:*

*Attesting Officer*

JAMES E. ROGAN
*Director of the United States Patent and Trademark Office* immersion depth intended, preferably 8 to 16 cm from the lower extremity or tip 20.

The duration of immersion of the probe in the electrolyte, the temperature of which, depending on its composition, is approximately 950° C., corresponds to the time curve in view of eliminating interference effects which can disturb the signals from the potentiometer and of the tip. The value thus calculated is then transmitted to the control and regulation system 17 (not pictured in figures).

Apart from the fact that it is possible to carry out, without manual intervention and without risk of pollution, more than 2,000 measurements of temperature to ±2° C. with a probe, with increased accuracy of the management of the cells because of the increased frequency of the measurements of temperature and of level, as well as the selection of the time to carry them out outside periods of transitory operation of electrolysis cells, the method and the device according to the invention are also capable of being adapted for the measurement of the level of the electrolyte/metal interface. Indeed, in a similar manner, by sinking the probe into the layer of metal a new variation in potential between the cathode substrate and the tip of the probe can be recorded when the probe crosses the electrolyte/metal interface. This variation is translated by a large reduction in probe-metal/cathode potential difference with respect to the probe-electrode/cathode potential difference previously recorded as a result of the substantial reduction in the resistance of the new medium.

In this way, from a common origin, by two successive series of measurements of the level of electrolyte and measurements of the level of metal, the average level of the electrolyte HT and the average level of the metal HM can be of acquisition by the probe of a temperature of at least 850° C. and preferably 920° C., increased by the time necessary to obtain, from this temperature, a very slow speed of heating of the probe, for example of less than 3° C. per second.

When this threshold is reached, the probe is raised to its initial position and the successive values of temperature measured by the thermocouple 21 are transmitted to the control and regulation system 17 (not pictured in figures) which determines, by extrapolation of the N different pairs of time/temperature values (ti, Ti), the temperature Tb of the electrolyte.

To carry out measurement of the level of the electrolyte, as a precaution the crust-breaker 9 is lowered in order to ensure the cleaning and passage of the probe 12 and then its raising, which allows the initiation of the sequence of measurement of the level of the electrolyte. This comprises the detection of the potential of the probe 12 with respect to the cathodic substrate 6 and the position signal from the potentiometer 14.

When the probe 12 is lowered, the potential with respect to the cathode 6 increases extremely rapidly when the tip 20 comes into contact with the bath 3, then drops back when this same tip leaves the electrolyte when the probe is raised after a duration of immersion preferably not exceeding 20 seconds. These variations in potential are recorded by the level measuring circuit, which precisely determines the instant when the probe dips into the electrolyte and calculates the thickness of the electrolyte after filtering and smoothing of the recording rapidly determined, and from these HB=HT−HM can be deduced, this being the thickness of the electrolyte, the volume of which one wishes to regulate precisely by the addition of ground solid bath or removal of electrolyte. This manner of determining the thickness of the electrolyte is clearly faster than that advo-